US006668799B2

(12) United States Patent
Ohira

(10) Patent No.: US 6,668,799 B2
(45) Date of Patent: Dec. 30, 2003

(54) CONTROL METHOD FOR IGNITION SYSTEM

(75) Inventor: Shigeyuki Ohira, Kuwana (JP)

(73) Assignee: Denso Corporation, Kariya (JP)

( * ) Notice: Subject to any disclaimer, the term of this patent is extended or adjusted under 35 U.S.C. 154(b) by 102 days.

(21) Appl. No.: 10/059,128

(22) Filed: Jan. 31, 2002

(65) Prior Publication Data

US 2002/0112711 A1 Aug. 22, 2002

(30) Foreign Application Priority Data

Feb. 20, 2001 (JP) ..... 2001-043405

(51) Int. Cl.[7] ..... F02P 5/00

(52) U.S. Cl. ..... 123/406.58; 123/41 E; 123/406.6; 123/406.65

(58) Field of Search ..... 123/406.58, 406.59, 123/406.6, 406.61, 406.62, 406.63, 406.64, 406.65, 406.66, 406.67, 406.68, 41 E

(56) References Cited

U.S. PATENT DOCUMENTS 4,596,138 A * 6/1986 Ito et al. ..... 73/118.1
4,841,933 A * 6/1989 McHale et al. ..... 477/111
4,843,556 A * 6/1989 Wakeman et al. ..... 701/111
4,899,282 A * 2/1990 Holmes ..... 701/111
5,669,354 A * 9/1997 Morris ..... 123/406.24
5,905,193 A * 5/1999 Hashizume et al. ..... 73/35.09
6,560,528 B1 * 5/2003 Gitlin et al. ..... 701/115

FOREIGN PATENT DOCUMENTS

JP 11-82270 3/1999

* cited by examiner

*Primary Examiner*—John Kwon
(74) *Attorney, Agent, or Firm*—Nixon & Vanderhye P.C.

(57) ABSTRACT

A rotor has teeth on a rotor body. The teeth indicate fixed ignition timings for both of normal and reverse rotations. The teeth also indicate beginning positions of a calculation ignition sequence and an excess advanced ignition sequence for both of the normal and reverse rotations. One of the teeth is longer than the other teeth to provide a signal for determining a rotating direction based on a detected signal from a timing sensor. In a stable rotating condition, a countdown process begins when the beginning position located on the forward side in the rotating direction from the cylinder to be ignited is detected, and the spark plug of the target cylinder sparks when the counting process finished.

20 Claims, 8 Drawing Sheets

FIG. 4
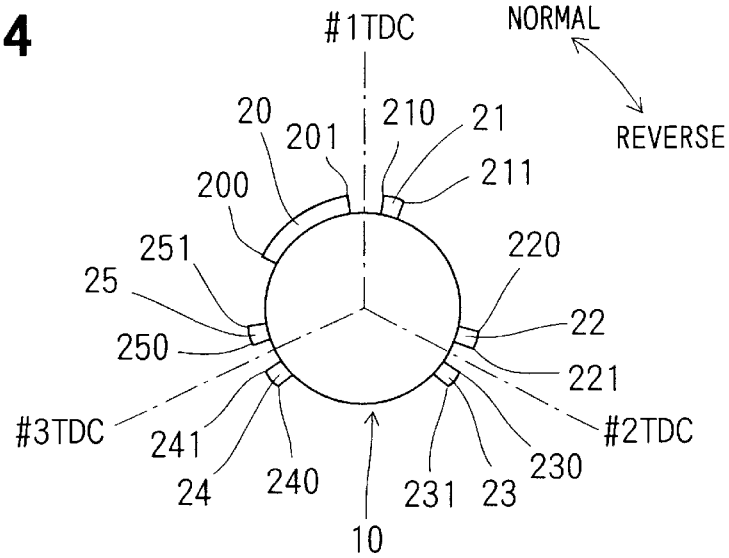
FIG. 5
| | | #1 | #2 | #3 |
|---|---|---|---|---|
| FIXED | NOR. | 201 | 221 | 241 |
| | REV. | 210 | 230 | 250 |
| CALC. | NOR. | 250 | 210 | 230 |
| | REV. | 221 | 241 | 201 |
| EX. AD. | NOR. | 250 | 210 | 230 |
| | REV. | 221 | 241 | 201 |
FIG. 6
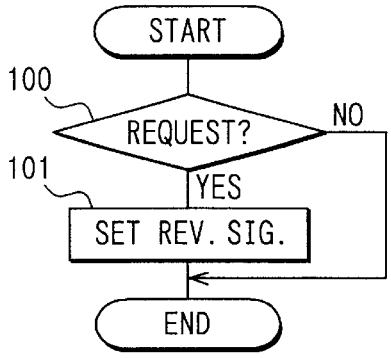

| | | #1 | #2 | #3 |
|---|---|---|---|---|
| FIXED | NOR. | 421 | 431 | 441 |
| | REV. | 422 | 432 | 442 |
| CALC. | NOR. | 442 | 422 | 432 |
| | REV. | 431 | 441 | 421 |
| EX. AD. | NOR. | 442 | 422 | 432 |
| | REV. | 431 | 441 | 421 |

| | | #1 |
|---|---|---|
| FIXED | NOR. | 521 |
| | REV. | 530 |
| CALC. | NOR. | 551 |
| | REV. | 540 |
| EX. AD. | NOR. | 551 |
| | REV. | 540 |

CONTROL METHOD FOR IGNITION SYSTEM

CROSS REFERENCE TO RELATED APPLICATION

This application is based on Japanese Patent Application No. 2001-43405 filed on Feb. 20, 2001 the contents of which are incorporated herein by reference.

BACKGROUND OF THE INVENTION

1. Field of the Invention

The present invention relates to an ignition system and a control method for an ignition system applied to an internal combustion engine (herein after the internal combustion engine is referred as the engine) being capable of rotating in both of directions, a normal rotation and a reverse rotation.

2. Description of Related Art

Conventionally, small size vehicles, e.g. motorcycle, moped, motor scooter, snowmobiles or the like, have no reverse gear to achieve compactness and light-weight. For the vehicle that cannot select a reverse position, an engine ignition system disclosed in JP-A-11-82270 is known in the art for permitting a reverse movement by rotating the engine in a reverse direction.

According to the ignition system disclosed in the publication, the system includes a rotor that has a tooth covering an angular position of Top Dead Center (TDC) located between a compression stroke and an expansion stroke. The system generates a spark on a spark plug of an engine cylinder indicated when a reference signal of the tooth is detected during an idling phase of the engine. On the other hand, in a stable driving condition, system sets a counter value on a counter or the like when the reference signal of the tooth is detected, and generates a spark on the spark plug when a countdown process for the counter value is finished. The ignition timing on the spark plug is always slightly advanced from the TDC of each cylinder.

SUMMARY OF THE INVENTION

According to the ignition system disclosed in JP-A-11-82270, however, since the rotor has only one tooth thereon, the rotor rotates almost full circle from a detection of the reference signal for the target cylinder to a spark in the target cylinder. That is, countdown period is too long. Therefore, ignition timing may shift if an engine rotating speed is changed while the countdown process. It is possible to be shorten a period of time from the reference signal to an ignition, if a length of the tooth in the rotating direction extends. But the length of the tooth could not be extended, because the reference signal is also utilized for an ignition signal of a fixed ignition sequence, e.g. during the idling. Further, it is difficult to manufacture the length of the tooth longer.

It is an object of the present invention to provide an ignition system and a control method for an ignition system which is capable of providing an improved accurate ignition control in both of a normal rotation and a reverse rotation.

According to an embodiment of the present invention described below, calculation indicators are located on a forward side of the position indicator in a normal rotation and a forward side of the position indicator in a reverse rotation. The system begins a calculation, e.g. countdown, when the sensor detects the calculation indicator corresponding to a cylinder to be sparked. The system provides an ignition in the cylinder corresponding to the calculation indicator when the countdown is finished. A calculating time period is shortened since a rotating angle range of the calculation indicator and the cylinder corresponding to the calculation indicator is shortened. It is possible to control the ignition timing of each cylinder accurately, because it is possible to decrease a deviation of the ignition timing even if an engine rotation speed is changed.

In the case that the engine has a plurality of cylinder, a position indicator for one of the cylinder may be a calculation indicator for a next cylinder located on a backward side in the rotating direction.

One of the position indicators may include three or more steps, which are located different intervals to indicate the rotating direction by a ratio of the intervals.

The calculation indicator of each cylinder for the normal rotation and the calculation indicator of each cylinder for the reverse rotation may be located on approximately the same distance from the TDC. It is possible to shorten processing time, because the same calculating process may be used for the normal and reverse rotation, e.g. countdown may be executed based on the same preset counting value.

The position indicator and the calculation indicator may be defined in accordance with each cylinder and the rotating direction.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

FIG. 4 is a plane view of a rotor showing positions of teeth thereon according to the first embodiment of the present invention;

FIG. 5 is a table indicating positions of fixed ignition and positions of beginning of countdowns according to the first embodiment of the present invention;

FIG. 6 is a flow-chart showing a switch detecting routine according to the first embodiment of the present invention;

DETAILED DESCRIPTION OF PREFERRED EMBODIMENTS

Embodiment will be explained with reference to figures.

(First Embodiment)

Figure 1:
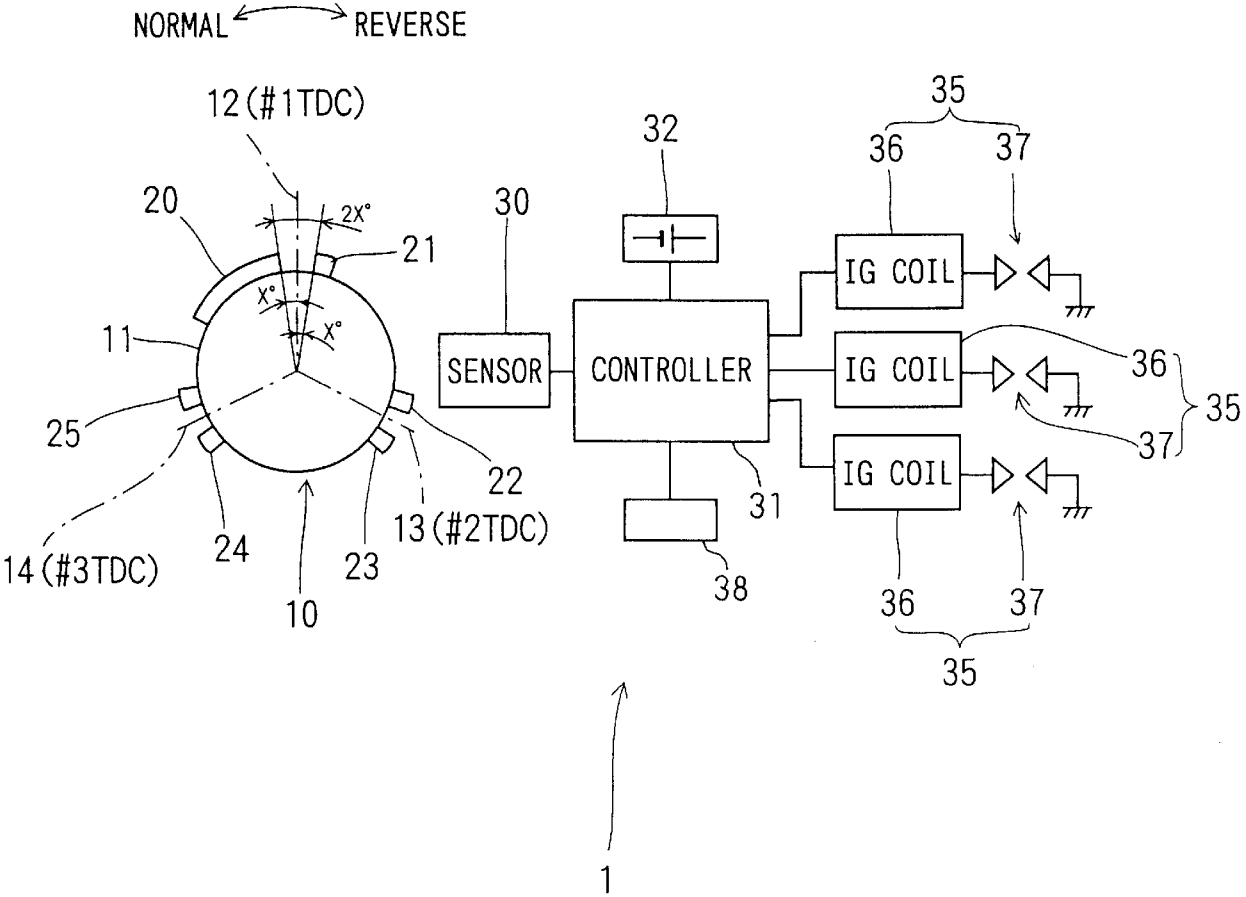
FIG. 1 is a schematic diagram of an ignition system according to a first embodiment of the present invention.

An ignition system according to a first embodiment of the present invention is disclosed in FIG. 1. The ignition system 1 controls ignition timings of two-cycle engine with three cylinders. A crankshaft is rotated by reciprocating pistons in cylinders. The ignition system 1 has a rotor 10, a timing sensor 30 and a controller 31.

The rotor 10 rotates with the crankshaft, and rotates one cycle synchronously with one cycle rotation of the crankshaft. The rotor 10 has a disk like rotor body 11 and teeth 20, 21, 22, 23, 24 and 25. The teeth are protruded toward radial outside, and are located outer surface of the rotor 11. The teeth provide edges (steps) for functioning indicators. The tooth 20 is longer in the rotating direction than the other teeth. The length of the tooth 20 is set so as to locate a forward edge of the tooth 20 close to a center of gap between a forward edge of the tooth 25 and forward edge of the tooth 21 when the engine rotates in the normal rotation. The teeth 20 and 21 correspond to a first cylinder. The teeth 22 and 23 correspond to a second cylinder. The teeth 24 and 25 correspond to a third cylinder. The teeth corresponding to each cylinder are located on both sides of a Top Dead Center (TDC). The teeth corresponding to each cylinder are spaced apart the same angle X°, e.g. 5°, from the TDC. A first TDC (#1TDC) 12, a second TDC (#2TDC) 13 and a third TDC (#3TDC) 14 are located even angular intervals 120° on the rotor body 11. The teeth 20, 21, 22, 23, 24 and 25 respectively have cylinder steps on the normal rotation side and the reverse rotation side as shown in FIG. 4. The cylinder steps on the normal rotation side are indicated by 200, 210, 220, 230, 240 and 250. The cylinder steps on the reverse rotation side are indicated by 201, 211, 221, 231, 241 and 251.

Figure 2:
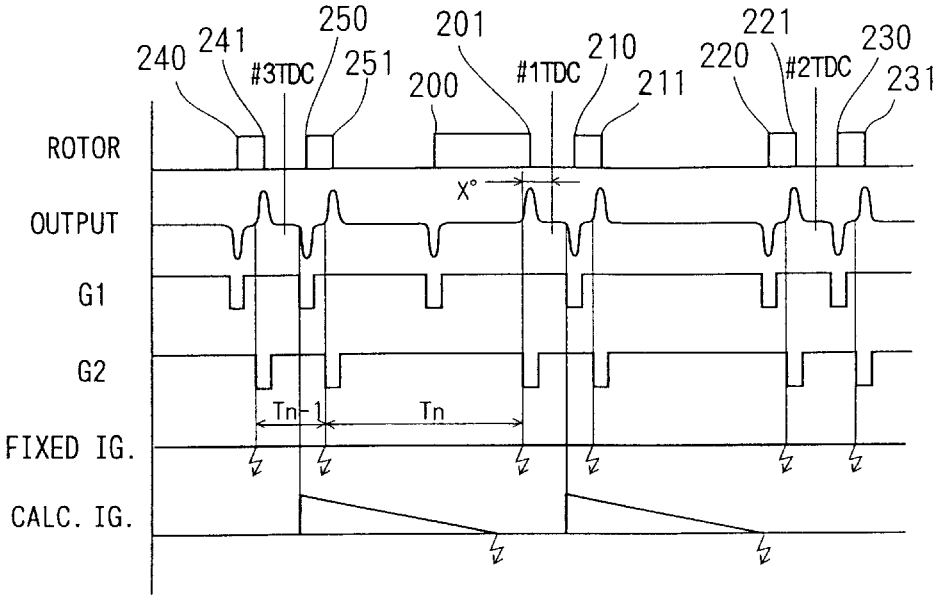
FIG. 2 is a time-chart showing ignition signals and sensor detection signals during a normal rotation according to the first embodiment of the present invention.
Figure 3:
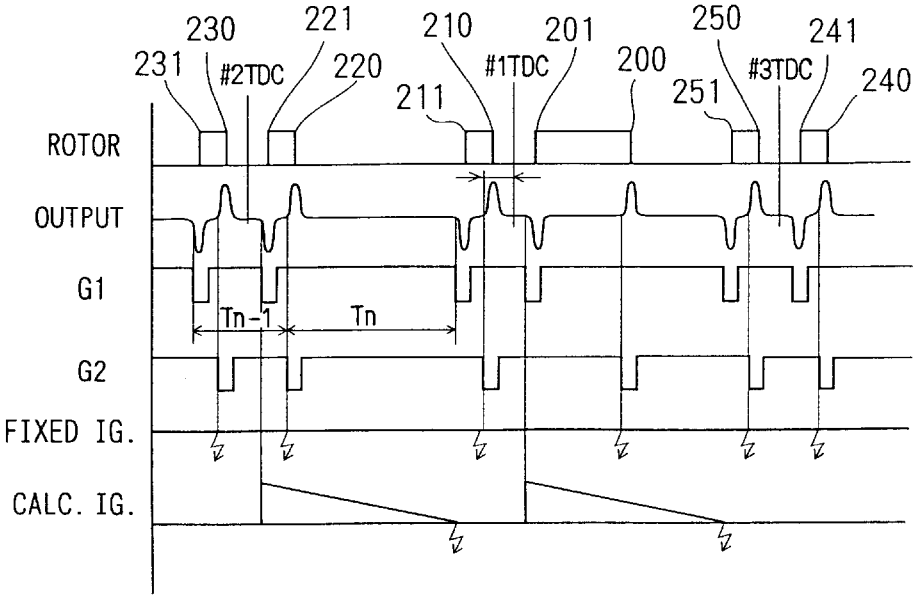
FIG. 3 is a time-chart showing ignition signals and sensor detection signals during a reverse rotation according to the first embodiment of the present invention.

The timing sensor 30, e.g. a electromagnetic pickup, detects the cylinder steps located on a forward and backward rotation sides of each tooth, and outputs a sensor signal as a detection signal as shown in FIGS. 2 and 3. The timing sensor may utilize a HALL effect sensor, an MRE sensor or the like.

The controller 31 as a control means has a CPU, ROM, RAM, controller circuit and the like, and powered by a source 32. Three ignition devices 35 are disposed on each cylinder, and each has an ignition coil 36 and a spark plug 37. The controller 31 provides a switching signal for the ignition coil 36 at an ignition timing of each cylinder. Then the spark plugs 37 makes spark in response to a high voltage generated by the ignition coil 36.

Next, detection of the rotating direction of the engine and control for changing the rotating direction will be explained. In FIGS. 2 and 3, left direction is advance direction and is the forward side of rotation, and right direction is retard direction and is the backward side of rotation.

The timing sensor 30 outputs positive and negative pulses on the forward and backward sides of each tooth as shown in FIGS. 2 and 3. The controller circuit in the controller 31 generates pulse signals, a forward signal (G1 signal) and a backward signal (G2 signal), based on the output signal of the timing sensor 30.

If the rotating direction should be changed while the engine is running. The driver may press the reverse switch 38. However, the rotating direction of the engine cannot be changed until the engine slow down. In the switch detecting routine illustrated in FIG. 6, in a step 100, it is determined that the reverse switch is pressed. In a step 101, a reverse flag is set ON. The switch detecting routine illustrated in FIG. 6 is intermittently executed in a main routine.

Figure 7:
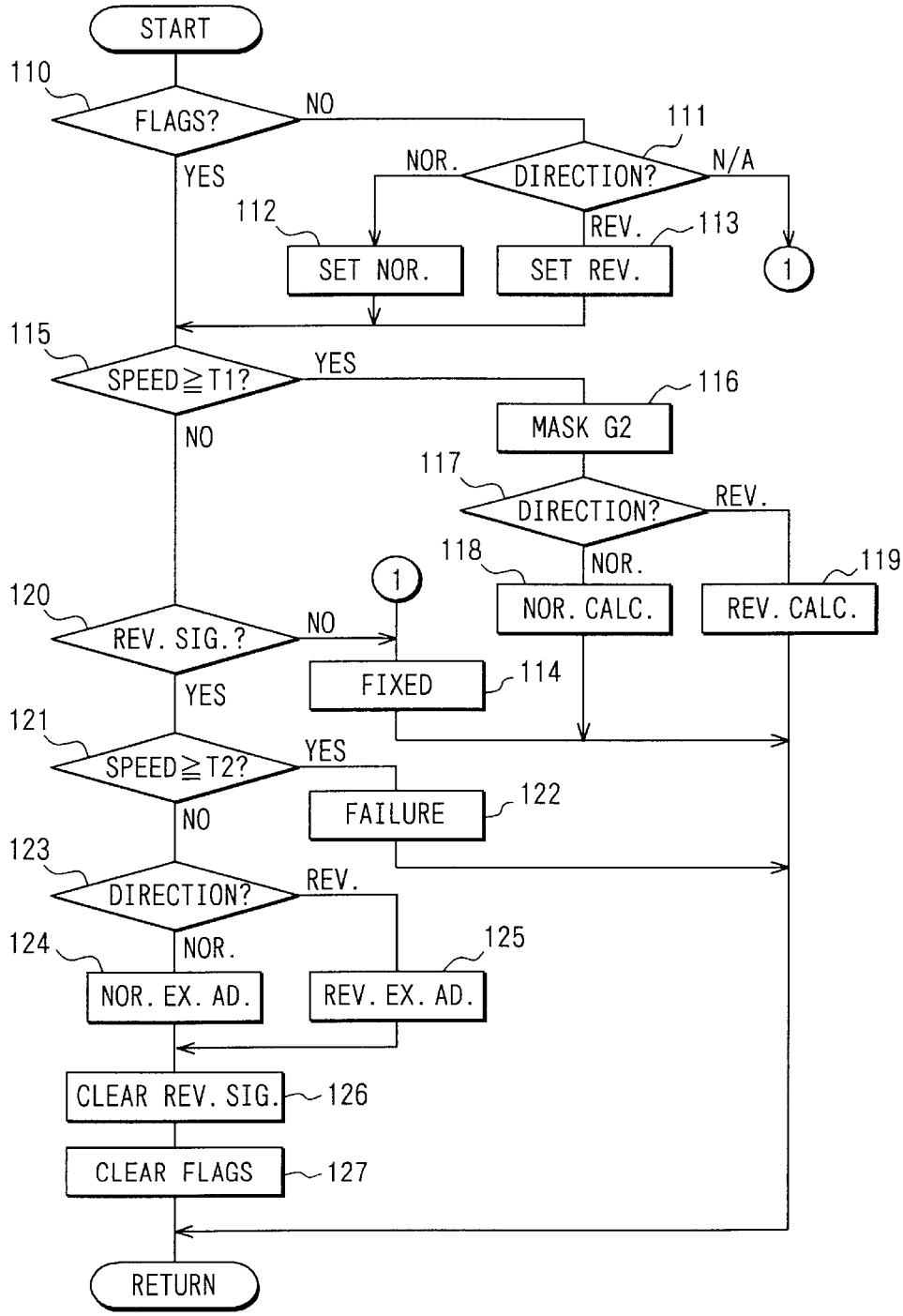
FIG. 7 is a flow-chart showing a control routine controlling the ignition system according to the first embodiment of the present invention.

A routine illustrated in FIG. 7 is an interrupt routine run every occurrence of the G1 and G2 signals.

In a step 110, it is determined that the rotating direction of the engine has been already determined or not. If the rotating direction has been not yet determined, the rotating direction of the engine is determined in a step 111. A determining method of the rotating direction will be explained.

In the G1 and G2 signals, an interval between a last second pulse and a last first pulse is denoted by Tn−1, an interval between a last first pulse and a present pulse is denoted by Tn. It is determined that (1) $\{(Tn-1+Tn)/Tn-1\} \geqq K$ when $Tn-1<Tn$. It is determined that (2) $\{(Tn-1+Tn)/Tn\} \geqq K$ when $Tn-1>Tn$. The value K is determined based on a length of each tooth. A difference between Tn−1 and Tn in the G1 and G2 signals is enlarged if lengths in the rotating direction of the teeth except for the tooth 20 are shortened within a range in which a mechanical strength is maintained and the timing sensor 30 could detect them. As a result, the value K may be increased. If the value K is increased, possibilities for determining the rotating direction of the engine by at least one of the above-described formulas (1) and (2) may be improved even if intervals of the G1 and G2 signals are changed in response to a deviation of rotating speed.

In a step 112, a normal rotation flag is set ON in response to a determination of the normal rotation, if a series of four meetings of at least one of the formulas (1) and (2) on the G2 signal is determined. In a step 113, a reverse rotation flag is set ON in response to a determination of the reverse rotation, if a series of four meetings of at least one of the formulas (1) and (2) on the G1 signal is determined. If the rotating direction is not available because the series of four meetings is not determined, in a step 114, the spark plug 118 sparks at fixed timing 50 before and after the TDC in response to every pulses of G2 signal by the controller circuit. The ignition timings of the fixed ignition sequence for each cylinder are shown in FIG. 5 by reference numbers of the steps in accordance with the rotating direction. Then the routine is finished. These sparks on both sides are adapted for both of the rotating directions.

In a step 115, a rotating speed of the engine is determined if the normal rotation flag or the reverse rotation flag is set ON. If the rotating speed is higher than a predetermined value T1, a mask signal for canceling the G2 signal is generated to inhibit the spark plugs 37 from a fixed ignition in response to every pulse of G2 signal. Next, ON or OFF of the normal and reverse rotation flags are inspected in a step 117, and then a counter value defining an ignition timing adapted to an operating condition of the engine is set in one of steps 118 and 119.

As shown in FIG. 5, calculation beginning positions of a calculation ignition sequence and a excess advanced ignition sequence are different from that of the fixed ignition sequence. The cylinder step 250 located on a forward side in the normal rotation is a calculation beginning position for the first cylinder. In the same manner, the step 210 defines a calculation beginning position for the second cylinder, and the step 230 defines a calculation beginning position for the third cylinder in the normal rotation.

The cylinder step 221 located on a forward side in the reverse rotation is a calculation beginning position for the first cylinder. In the same manner, the step 241 defines a calculation beginning position for the second cylinder, and the step 201 defines a calculation beginning position for the third cylinder in the reverse rotation.

In FIGS. 2 and 3, the other interrupt routine is started when a signal of the calculation turns off, in the other word when the counter reaches 0, to make the spark plug 37 sparks. In FIGS. 2 and 3, the ignition pulses (sparks) are indicated by lighting-shaped arrows. According to each of the cylinders, the tooth located on a forward position determines the calculation beginning position. That is, the teeth 20, 21, 22, 23, 24 and 25 works as both of the position indicator for the fixed ignition sequence and the calculation indicator for the calculation ignition sequence and the excess advanced ignition sequence. Further, angles between the TDC of each cylinder and the calculation beginning position in the normal rotation, and between the TDC of each cylinder and the calculation beginning position in the reverse rotation are the same.

If it is determined that the rotating speed is lower than the predetermined value T1 in the step 115, it is determined that the reverse switch 38 is pressed or not in a step 120. If the reverse switch 38 is not pressed, a fixed ignition sequence is carried out in a step 114. If the reverse switch 38 is pressed, the rotating speed of the engine and a predetermined value T2 are compared in a step 121. If the rotating speed is higher than the predetermined value T2, the rotating speed is too high. Then, in a step 122, the spark plug corresponding to the cylinder is inhibited from sparking to decrease the rotating speed.

If the rotating speed is lower than the predetermined value T2, the engine can be reversed. Then, an excess advanced ignition sequence for the normal rotation is carried out during the normal rotation in a step 124, or an excess advanced ignition sequence for the reverse rotation is carried out during the reverse rotation in a step 125. The predetermined value T2 is smaller than the predetermined value T1. The excess advanced ignition sequence begins countdown process from the calculation indicator as well as the calculation ignition sequence described above during both of the normal and reverse rotations, and commands the spark plug to spark when the countdown process is finished. The spark plug sparks at an advanced position more than the ordinal calculation ignition sequence by a smaller counter preset value than the calculation ignition sequence. As a result, the piston is pushed back before the piston reaches to the TDC, and the engine rotating direction is reversed. Then, the routine clears the reverse flag in a step 126, and also clears the normal rotation flag, the reverse rotation flag and the engine rotating speed in a step 127.

If the program in the controller 31 is still not functioning in an engine-starting phase, the spark plug 37 sparks at fixed timings in response to every pulses of the G2 signal. In the fixed ignition sequence at the engine starting phase, although the spark plugs 37 sparks at both before and after the TDC of each cylinder, since fuel have already combusted, sparks after the TDC don't prevent the engine rotation.

In this embodiment, the cylinder step 201 is a position indicator for defining a fixed ignition timing for the first cylinder #1 in the normal rotation. The cylinder step 250 is a calculation indicator for defining a beginning of the calculation for the first cylinder #1 in the normal rotation. The step 201 is a calculation indicator for defining a beginning of the calculation for the third cylinder #3 in the reverse rotation. The step 250 is a position indicator for defining a fixed ignition timing for the third cylinder #3 in the reverse rotation. Therefore, two indicators are located between the TDCs. Further, the step 200 is located as a rotating direction indicator between the position and calculation indicators. The step 200 is irregularly located between the TDCs to indicate the first cylinder #1 and the rotating direction.

In the first embodiment, a pair of teeth is provided for each of the cylinders, and only the tooth 20 which is one of the pair of teeth for the first cylinder is formed longer in the rotating direction than that of the other tooth 21. Therefore, it is possible to determine the rotating direction of the engine by using the timing sensor 30 alone by comparing the intervals of pulses utilizing a ratio in the G1 and G2 signals. As a result, number of parts is reduced. Further, since the assembling steps for the sensor is reduced, it is possible to lower a manufacturing cost.

Further, since the teeth are located apart the same angle from the TDC of each cylinder in both before and after of the rotating directions, it is possible to make the spark plugs spark using the same sequence in both of the fixed ignition sequences in the normal and reverse rotations. As a result, it is possible to achieve the similar driving feelings in both of the normal and reverse rotations. Although the fixed ignition timings in the normal and reverse rotation are designed at the same angles 5° in the first embodiment, these angles may be designed different angles, e.g. 4, 7 or the like, in accordance with the needs.

(Second Embodiment)

A second embodiment of the present invention is disclosed in FIGS. 8 through 11.

Figures 8, 9:
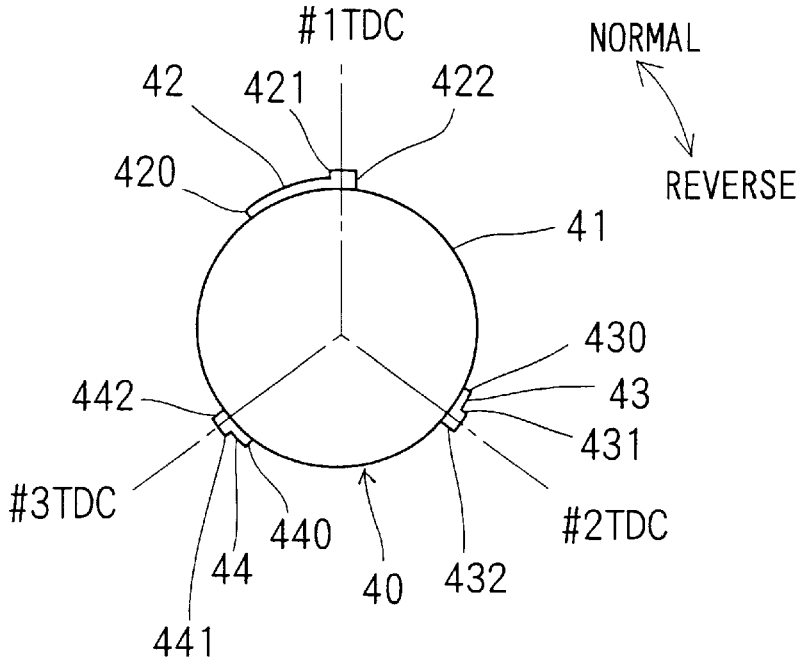
FIG. 8 is a plane view of a rotor showing positions of teeth thereon according to a second embodiment of the present invention.
FIG. 9 is a table indicating positions of fixed ignition and positions of beginning of countdowns according to the second embodiment of the present invention.

A rotor 40 disclosed in FIG. 8 is utilized for the two-cycle engine with three cylinders, and rotates one cycle synchronously with one cycle rotation of the crankshaft, as well as the first embodiment. The rotor 40 has a disk like rotor body 41 and teeth 42, 43 and 44. On the tooth 42, an interval in the rotating direction between the cylinder steps 420 and 421 is longer than an interval in the rotating direction between the cylinder steps 421 and 422. On the teeth 43 and 44 respectively, intervals in the rotating direction between neighboring cylinder steps are approximately the same.

The interval between the cylinder steps 420 and 421 is set so as to locate the cylinder step 420 of the tooth 42 close to a center of the cylinder step 441 and cylinder step 421. The cylinder steps 421 and 422 correspond to the first cylinder. The cylinder steps 431 and 432 correspond to the second cylinder. The cylinder steps 441 and 442 correspond to the third cylinder. The respective pair of the cylinder steps corresponding to each cylinder are located on both sides of the TDC. The cylinder steps corresponding to each cylinder are spaced apart the same angle from the TDC. A first TDC (#1TDC) 12, a second TDC (#2TDC) 13 and a third TDC (#3TDC) 14 are located even angular intervals 120° on the rotor body 41.

Figure 10:
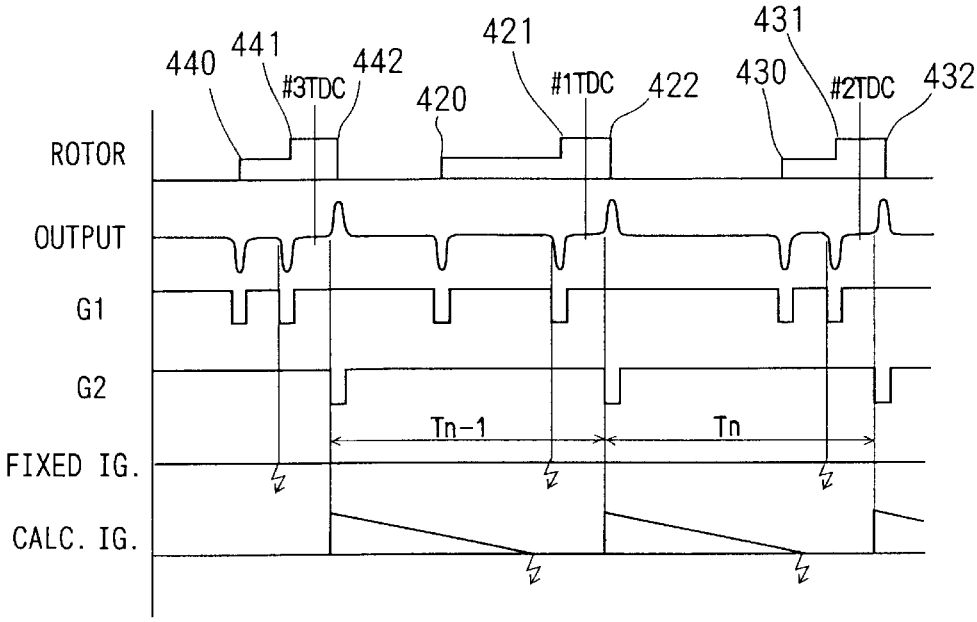
FIG. 10 is a time-chart showing ignition signals and sensor detection signals during a normal rotation according to the second embodiment of the present invention.
Figure 11:
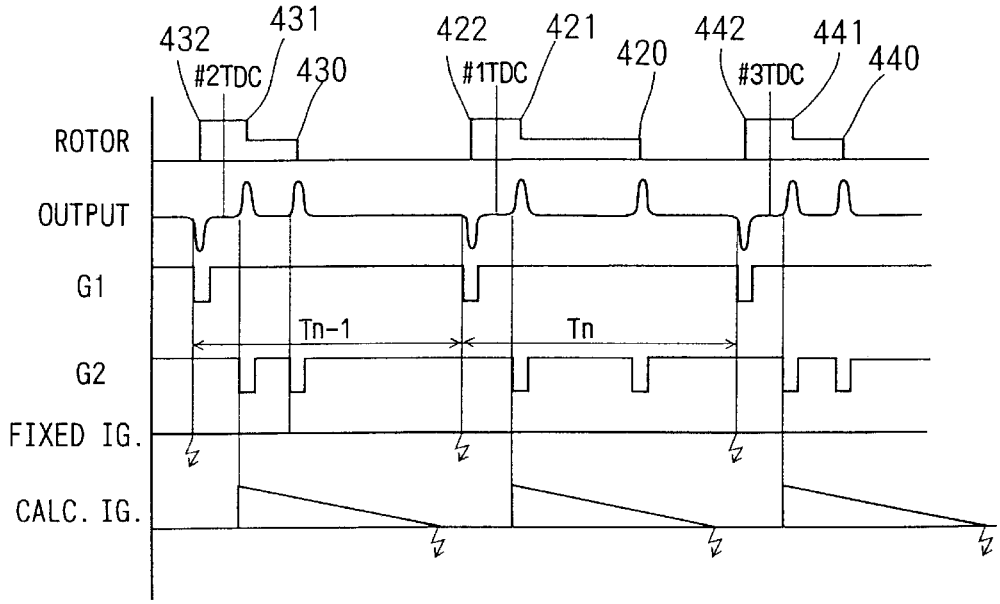
FIG. 11 is a time-chart showing ignition signals and sensor detection signals during a reverse rotation according to the second embodiment of the present invention.

A determination of the rotating direction is executed as follows. First, Tn−1/Tn is calculated in accordance with the G1 and G2 signals as shown in FIGS. 10 and 11. If a series of three calculation results for Tn−1/Tn of G2 signal were approximately 1, the normal rotation is detected. If a series of three calculation results for Tn−1/Tn of G1 signal were approximately 1, the reverse rotation is detected.

In case of the calculation ignition sequence and the excess advanced ignition sequence, the beginning positions of the countdown processes of the preset counter values are shown in FIG. 9. In the normal rotation, the beginning positions are the cylinder steps 442, 422 and 432 of the teeth 44, 42 and 43 which are located forward side in the rotating direction from the first, second and third cylinders respectively. In the reverse rotation, the beginning positions are the cylinder steps 431, 441 and 421 of the teeth 43, 44 and 42 which are located forward side in the rotating direction from the first, second and third cylinders. In FIGS. 10 and 11, the other interrupt routine is started when the counter reaches 0, and the routine makes the spark plug 37 sparks. In the case of the excess advanced ignition sequence, the counter value is set smaller than the ordinary calculation ignition sequence. According to the each cylinder, the tooth of the cylinder located on the forward side in the rotating direction defines the beginning position of the countdown process of the calculation and excess advanced ignition sequences. That is, the teeth 42, 43 and 44 works as the position indicator and the calculation indicator.

(Third Embodiment)

A third embodiment of the present invention is disclosed in FIGS. 12 through 15.

Figures 12, 13:
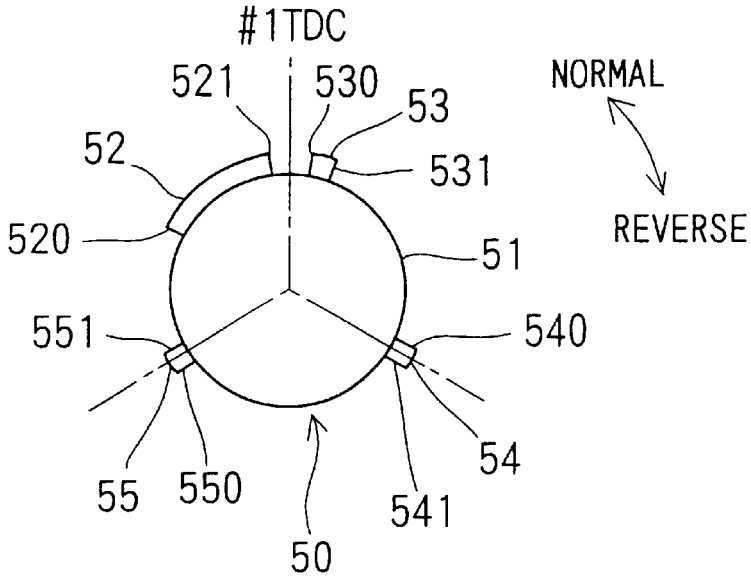
FIG. 12 is a plane view of a rotor showing positions of teeth thereon according to a third embodiment of the present invention.
FIG. 13 is a table indicating positions of fixed ignition and positions of beginning of countdowns according to the third embodiment of the present invention.

A rotor 50 disclosed in FIG. 12 is utilized for the two-cycle engine with a single cylinder, and rotates one cycle synchronously with one cycle rotation of the crankshaft. The rotor 50 has a disk like rotor body 51 and teeth disposed on an outer surface of the rotor body and protruded radial outside. The teeth have teeth 52 and 53 as the position indicators and teeth 54 and 55 as the calculation indicators. The teeth 52, 53, 54 and 55 provide steps 520, 521, 530, 531, 540, 541, 550 and 551 from a forward side of the normal rotation. The steps 520, 521, 530 and 531 are the cylinder steps. In the first cylinder, a length in the rotating direction of the tooth 52 is longer than that of the tooth 53. That is, an interval in the rotating direction between the step 520 and the step 521 is longer than an interval in the rotating direction between the step 530 and the step 531.

The length in the rotating direction of the tooth 52 is set so as to locate the step 520 of the tooth 52 close to middle of the step 550 and the step 530. The 521 and 530 corresponding to the first cylinder are located on both sides of the TDC between the compression stroke and the expansion stroke of the first cylinder, and are spaced apart the same angle from the TDC. A first TDC (#1TDC), the tooth 54 and the tooth located even angular intervals 120° on the rotor body 51.

Figure 14:
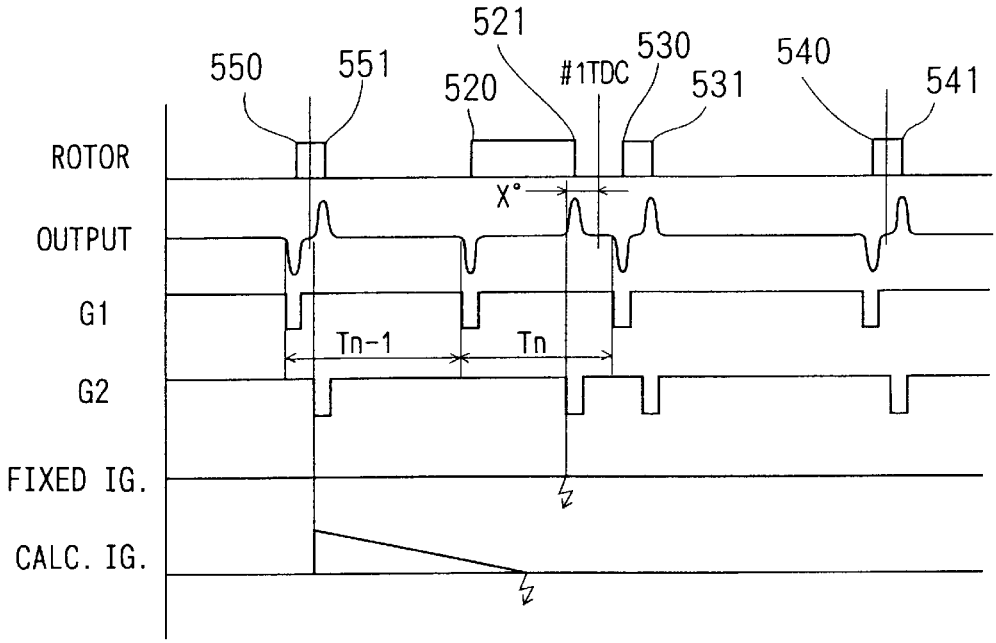
FIG. 14 is a time-chart showing ignition signals and sensor detection signals during a normal rotation according to the third embodiment of the present invention.
Figure 15:
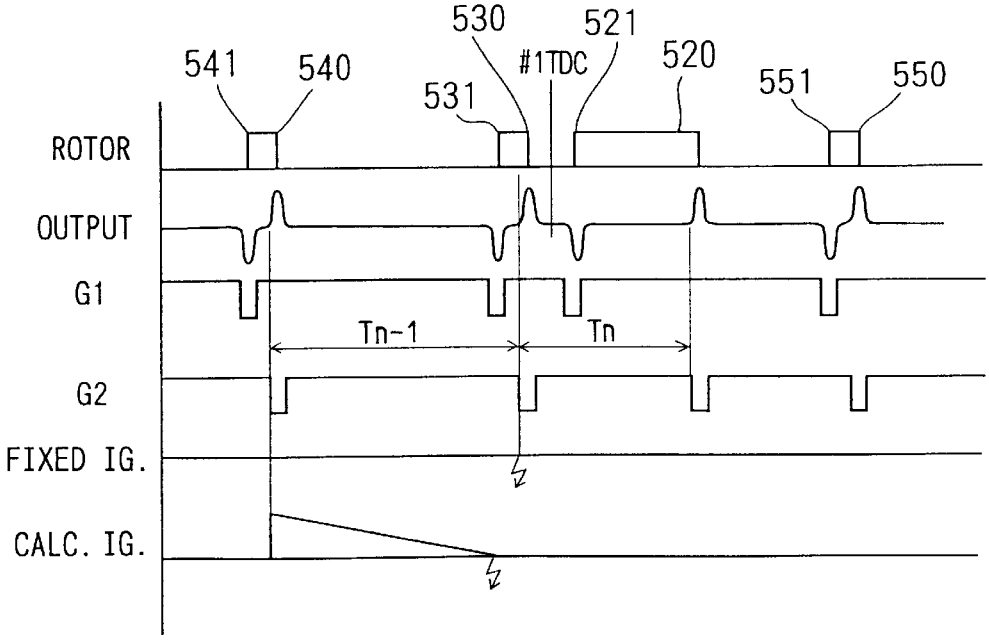
FIG. 15 is a time-chart showing ignition signals and sensor detection signals during a reverse rotation according to the third embodiment of the present invention.

A determination of the rotating direction is executed as follows. First, Tn−1/Tn is calculated in accordance with the G1 and G2 signals as shown in FIGS. 14 and 15. If a series of three of the calculation result of G1 signal meets $(Tn-1/Tn) \leqq K$ continuously, the normal rotation is determined. If a series of three of the calculation result of G2 signal meets $(Tn-1/Tn) \leqq K$ continuously, the reverse rotation is determined. The value K is set in accordance with the length of each of the teeth.

In case of the calculation ignition sequence and the excess advanced ignition sequence, the beginning positions of the countdown processes are shown in FIG. 13. In the normal rotation, the beginning position is the step 551 of the tooth 55 as the calculation indicator. The step 551 is located on the forward side in the rotating direction of the first cylinder. In the reverse rotation, the beginning position is the step 540 of the tooth 54. The step 540 is located on the forward side in the rotating direction of the first cylinder. In FIGS. 14 and 15, the other interrupt routine is started when the counter reaches 0, and the routine makes the spark plug sparks. In the case of the excess advanced ignition sequence, the counter value is set smaller than the ordinary calculation ignition sequence.

In the embodiments described above, a tooth as the calculation indicator is located on a position spaced apart a predetermined angle from the position indicator of each cylinder independently from a tooth as the position indicator of each cylinder, and the position indicator and the calculation indicator are defined in accordance with the rotating direction and each cylinder. Therefore, since a rotating angle from the calculation indicator to an ignition position is decreased, a time period for the countdown process is shortened. It is possible to control the ignition timing accurately, because a deviation of the ignition timing is reduced even if the rotating speed is changed during the countdown process.

Although the present invention is applied to the two-cycle engine with three cylinders or the two-cycle engine with single cylinder in the above-described embodiments, the present invention may be applied to the engine with any number of cylinders if the teeth can be located. The present invention may be applied to a four-cycle engine. In the case of above, the rotor may be attached on a rotating shaft which rotates one cycle during the engine rotates two cycle.

Although the teeth protruding toward a radial outside of the rotor body are formed as the position indicators and the calculation indicators, it is possible to form depressions on the rotor body as the position indicators and calculation indicators. Further, in the case that the deviation of the rotating speed of the engine is small enough, it is possible to determine the rotating direction based on at least one of the G1 and G2 signals.

Further, it is preferable to apply the present invention for an ignition system of an engine utilized to an apparatus requiring a stable engine rotation in both of the normal and reverse direction, e.g. belt-conveyer or the like, besides the vehicle.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A control method for an ignition system for an engine being capable of rotating in both of normal and reverse directions and has at least one cylinder, the ignition system comprising a rotor, a sensor and a controller, the rotor being rotated synchronously with the engine and having a position indicator for determining a fixed ignition timing of the cylinder in the normal and reverse rotation and calculation indicators defining beginnings of a calculation of a calculation ignition, the calculation indicators being located on a forward side of the position indicator in the normal rotation and a forward side of the position indicator in the reverse rotation, the sensor detecting the position indicator and the calculation indicators, and the controller controlling ignition timings of an ignition device and determining rotating direction of the rotor based on a detected signal of the position indicator and the calculation indicators outputted from the sensor, the method comprising the steps of:

beginning a calculation in response to a detection of the calculation indicator corresponding to each cylinder by the sensor; and commanding an ignition on the cylinder corresponding to the calculation indicator in response to a finish of the calculation.

2. The control method for an ignition system according to claim 1, wherein the engine has a plurality of cylinders, and the position indicator for a cylinder located on a forward side in the rotating direction works as the calculation indicator for a following cylinder.

3. The control method for an ignition system according to claim 1, wherein the sensor is alone, the position indicator includes three or more steps which are located on both rotating direction sides of the TDC of the cylinder, a distance between the steps neighboring on at least one of the position indicator is different, and the controller calculates a ratio of the distances based on the detected signals of the steps to determine the rotating direction.

4. The control method for an ignition system according to claim 1, wherein the calculation indicator for the each cylinder in the normal rotation and the calculation indicator for the each cylinder in the reverse rotation are located on approximately the same distance from the TDC of the each cylinder.

5. The control method for an ignition system according to claim 1, wherein the position indicator and the calculation indicator are defined independently according to a corresponding cylinder and the rotating direction.

6. An ignition system for an engine being capable of rotating in both of normal and reverse directions and has at least one cylinder, the ignition system comprising:

an ignition device for providing ignitions in the cylinder;

a rotor being rotated synchronously with the engine having a plurality of indicators;

a sensor for detecting the indicators on the rotor; and a controller for controlling ignition timings of an ignition device and determining rotating direction of the rotor based on a detected signal outputted from the sensor, wherein the indicators on the rotor are located on both sides of a top dead center for defining fixed ignition timings in both of the normal and reverse rotation and for defining beginnings of a calculation of a calculation ignition, and wherein the controller includes:

a fixed ignition means for commanding an ignition to the ignition device in response to a detection of the indicator located before the top dead center; and a calculation ignition means for commanding an ignition to the ignition device in response to a finish of a calculation which is started in response to a detection of the indicator located before the indicator that defines a fixed ignition timing by the fixed ignition means.

7. An ignition system according to claim 6, wherein the indicators are located symmetrically to the top dead center.

8. An ignition system according to claim 6, wherein the rotor further includes rotation indicators, and wherein the controller includes a rotation determining means for determining a rotating direction by using a detection of the rotation indicator.

9. An ignition system according to claim 8, wherein the controller further includes an ignition means for changing the rotating directions in response to a request from an operator.

10. An ignition system according to claim 9, wherein the rotation indicator is located between the indicators used in the fixed ignition means and the calculation means and the rotation indicator provides different signals on an output of the sensor with respect to the rotating directions.

11. An ignition system according to claim 10, wherein at least two of the indicators are located between the top dead centers, the first one defining the beginning of the calculation in the normal rotation and the fixed ignition timing in the reverse rotation, the second one defining the fixed ignition timing in the normal rotation and the beginning of the calculation in the reverse direction.

12. An ignition system according to claim 11, wherein the fixed ignition means includes:

a normal fixed ignition means activated when the normal rotation is determined by the rotation determining means, for commanding the ignition in response to the second indicator; and a reverse fixed ignition means activated when the reverse rotation is determined by the rotation determining means, for commanding the ignition in response to the first indicator, and wherein the calculation means includes:

a normal calculation means activated when the normal rotation is determined by the rotation determining means, for commanding the ignition based on the first indicator; and a reverse calculation means activated when the reverse rotation is determined by the rotation determining means, for commanding the ignition based on the second indicator.

13. An ignition system according to claim 6, wherein the engine has a plurality of cylinders, and wherein the indicators located before the top dead centers of the cylinders define the fixed ignition timings and the indicators located after the top dead centers of the cylinders define the beginnings of the calculations for the next cylinders.

14. An ignition system according to claim 6, wherein the indicators are provided by steps that is detectable by the sensor.

15. An ignition system according to claim 14, wherein the rotor has at least two steps between the top dead centers of the cylinders, the first one defining the beginning of the calculation in the normal rotation and the fixed ignition timing in the reverse rotation, the second one defining the fixed ignition timing in the normal rotation and the beginning of the calculation in the reverse direction.

16. An ignition system according to claim 15, wherein the rotor has another step irregularly located between the top dead centers for defining the rotating direction.

17. An ignition system according to claim 14, wherein the rotor has protrusions that define the steps.

18. An ignition system according to claim 17, wherein the engine has a plurality of cylinders, and the rotor has pair of the protrusions on both sides of the top dead center for each of the cylinders.

19. An ignition system according to claim 18, wherein one of the protrusions is different from the other protrusion for indicating a rotating direction.

20. An ignition system according to claim 17, wherein the engine has a plurality of cylinders, and the rotor has one protrusion extending over both sides of the top dead center for each of the cylinders.

* * * * *